US008647131B1

(12) United States Patent
Wiebusch

(10) Patent No.: US 8,647,131 B1
(45) Date of Patent: Feb. 11, 2014

(54) ELECTRICAL CORD WITH REPLACEABLE PLUGS

(71) Applicant: Wiebusch Enterprises, Inc., Emma, MO (US)

(72) Inventor: Randall Brian Wiebusch, Emma, MO (US)

(73) Assignee: Wiebusch Enterprises, Inc., Emma, MO (US)

( * ) Notice: Subject to any disclaimer, the term of this patent is extended or adjusted under 35 U.S.C. 154(b) by 0 days.

(21) Appl. No.: 13/676,830

(22) Filed: Nov. 14, 2012

(51) Int. Cl.
*H01R 29/00* (2006.01)

(52) U.S. Cl.
USPC ..... 439/170; 439/651

(58) Field of Classification Search
USPC ..... 439/105–107, 170–172, 218, 221, 439/650–652
See application file for complete search history.

(56) References Cited

U.S. PATENT DOCUMENTS 1,864,353 A * 6/1932 Hubbell, Jr. ..... 439/651
2,100,094 A * 11/1937 Wahl ..... 439/592
5,007,857 A * 4/1991 Wright ..... 439/490
5,320,560 A * 6/1994 Fladung ..... 439/490
5,340,331 A * 8/1994 Bohlen et al. ..... 439/502
5,409,397 A * 4/1995 Karman ..... 439/484
5,513,998 A * 5/1996 Kim ..... 439/170
6,398,589 B1 * 6/2002 Congelliere ..... 439/655
6,500,025 B1 * 12/2002 Moenkhaus et al. ..... 439/502
7,220,136 B1 * 5/2007 Green ..... 439/106
7,422,452 B2 * 9/2008 Achtner et al. ..... 439/106
7,604,511 B1 * 10/2009 Johnson ..... 439/651
7,658,635 B2 * 2/2010 Gilchrist ..... 439/357

* cited by examiner

*Primary Examiner* — Thanh Tam Le
(74) *Attorney, Agent, or Firm* — Hovey Williams LLP

(57) ABSTRACT

An electrical cord plug having a receiving plug physically and electrically couplable with wires of an electrical cord and a detachable plug detachably physically and electrically couplable with the receiving plug. The detachable plug may be a male plug configured to plug into an electrical outlet or a female plug configured to receive a male plug from an electrical cord or device. The receiving plug may have conductive prongs or conductive ports for physically and electrically interfacing with conductive ports or conductive prongs of the detachable plug, respectively. The receiving plug and the detachable plug may each have non-conductive housings mechanically and detachably attachable with each other such that, if damaged, the detachable plug may be removed and replaced with a new detachable plug.

6 Claims, 6 Drawing Sheets

ELECTRICAL CORD WITH REPLACEABLE PLUGS

BACKGROUND

The male and female-type plugs on the ends of extension cords and other electrical cords are often stepped on, run-over, or other otherwise damaged during use. When a plug of an electrical cord is damaged, it must be repaired or the entire electrical cord must be replaced. Replacing the entire electrical cord may be expensive or impractical, especially if the electrical cord is hardwired to the device to which it provides power. To repair the electrical cord, the damaged plug must be cut off and a new plug must be spliced to the electrical cord. This can be a time-consuming, labor-intensive process requiring a skilled person to safely splice the new plug onto the electrical cord.

SUMMARY

Embodiments of the present invention solve the above-mentioned problems and provide a distinct advance in electrical cords. A first embodiment of the invention is an electrical cord having a replaceable plug at one or more ends of its ends. The replaceable plug may have a receiving plug and a detachable plug detachably attachable to the receiving plug. The receiving plug may be physically and electrically hardwired to the electrical cord and the detachable plug may be physically and electrically detachably coupled to the receiving plug. If the detachable plug becomes damaged, it can be quickly and easily removed from the receiving plug and replaced with another detachable plug. The detachable plug may have a conductive port and a conductive prong electrically connected with the conductive port. Depending on if the detachable plug is male or female, either its conductive port or its conductive prong may be configured to be electrically coupled with an electrical outlet or conductive prongs of another electrical plug, respectively. Additionally, the conductive prong or the conductive port of the detachable plug may be configured to physically and electrically couple with a conductive port or a conductive prong of the receiving plug.

A second embodiment of the invention is a replacement plug that may be used to repair a conventional extension cord or other electrical cord. The replacement plug may have a detachable plug and a receiving plug physically and electrically couplable with the detachable plug. The receiving plug may be attached to any electrical cord in need of repair, and is not necessarily initially hardwired to an electrical cord. For example, a damaged electrical cord end may be cut and the wires thereof may be physically and electrically coupled with wire termination prongs of the receiving plug. A cord clamp may also be mechanically attached to a housing of the receiving plug and may clamp the electrical cord securely to the receiving plug once the wires are connected to the wire termination prongs. The wire termination prongs may be electrically coupled with conductive ports or prongs of the receiving plug. As in the first embodiment, the conductive ports or conductive prongs of the receiving plug may be physically, electrically, and detachably attached to conductive prongs or conductive ports of the detachable plug. If the detachable plug subsequently becomes damaged, it can be quickly and easily removed from the receiving plug and replaced with another detachable plug.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

BRIEF DESCRIPTION OF THE DRAWING FIGURES

Embodiments of the present invention are described in detail below with reference to the attached drawing figures, wherein.

Figure 4:
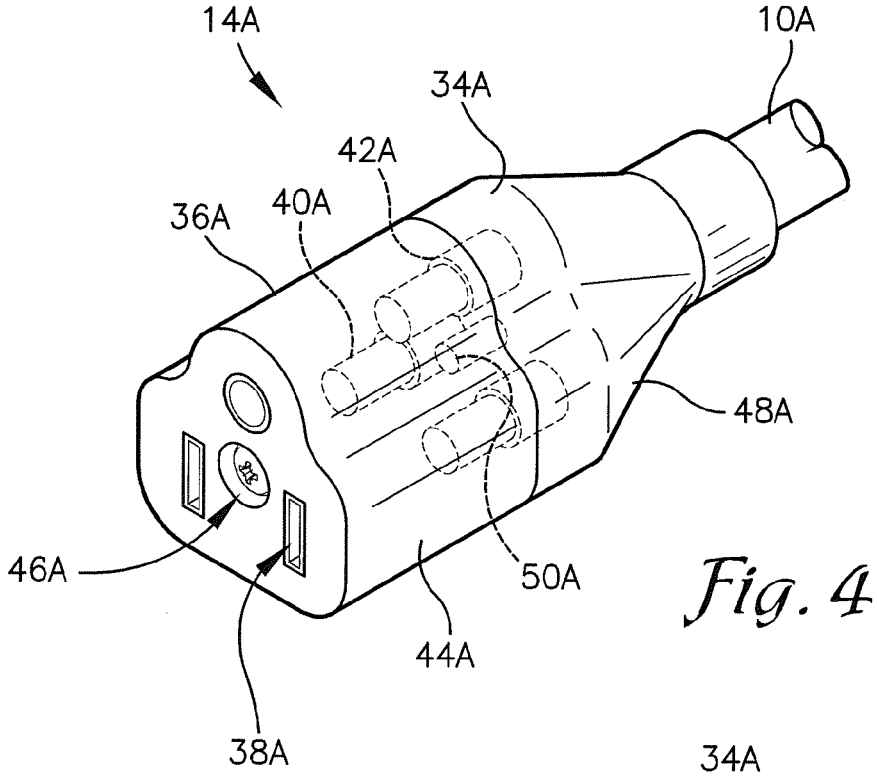
FIG. 4 is a perspective view of a female replacement plug of the electrical cord of FIG. 1.
Figure 5:
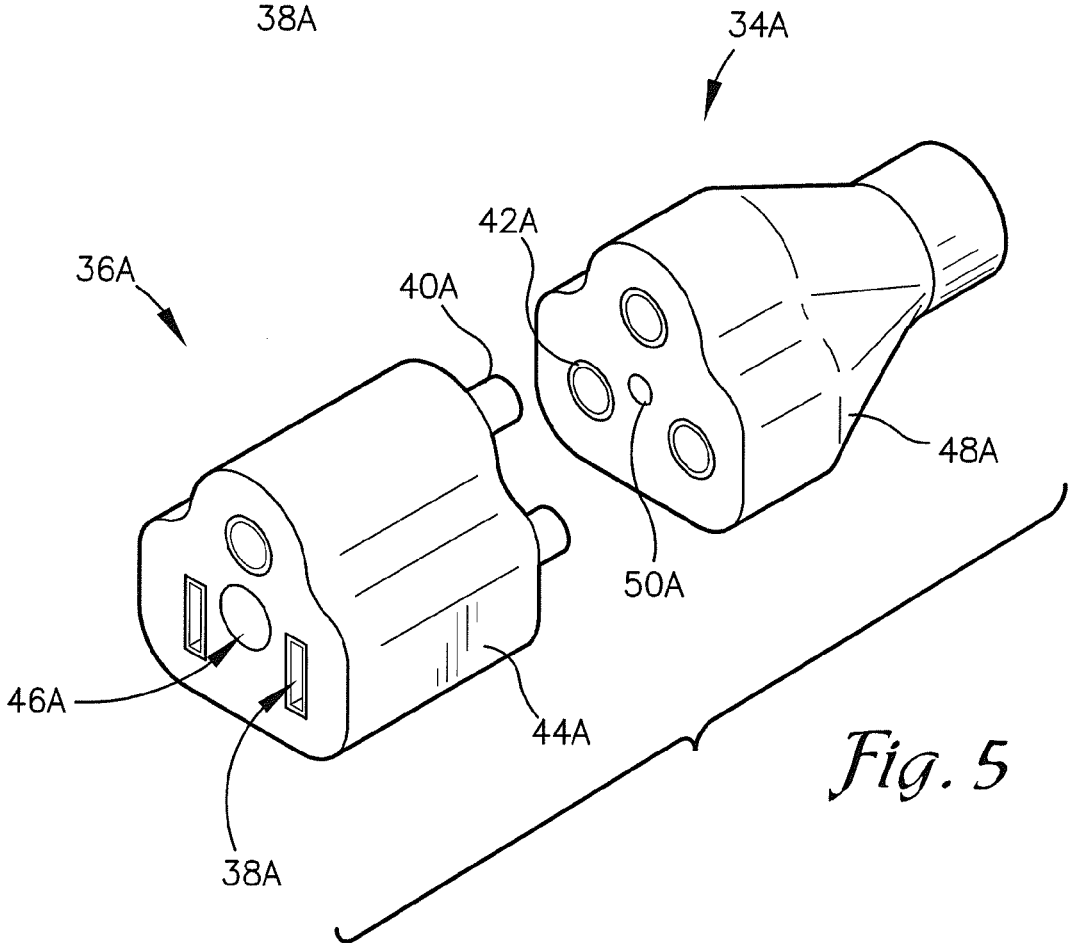
Figure 6:
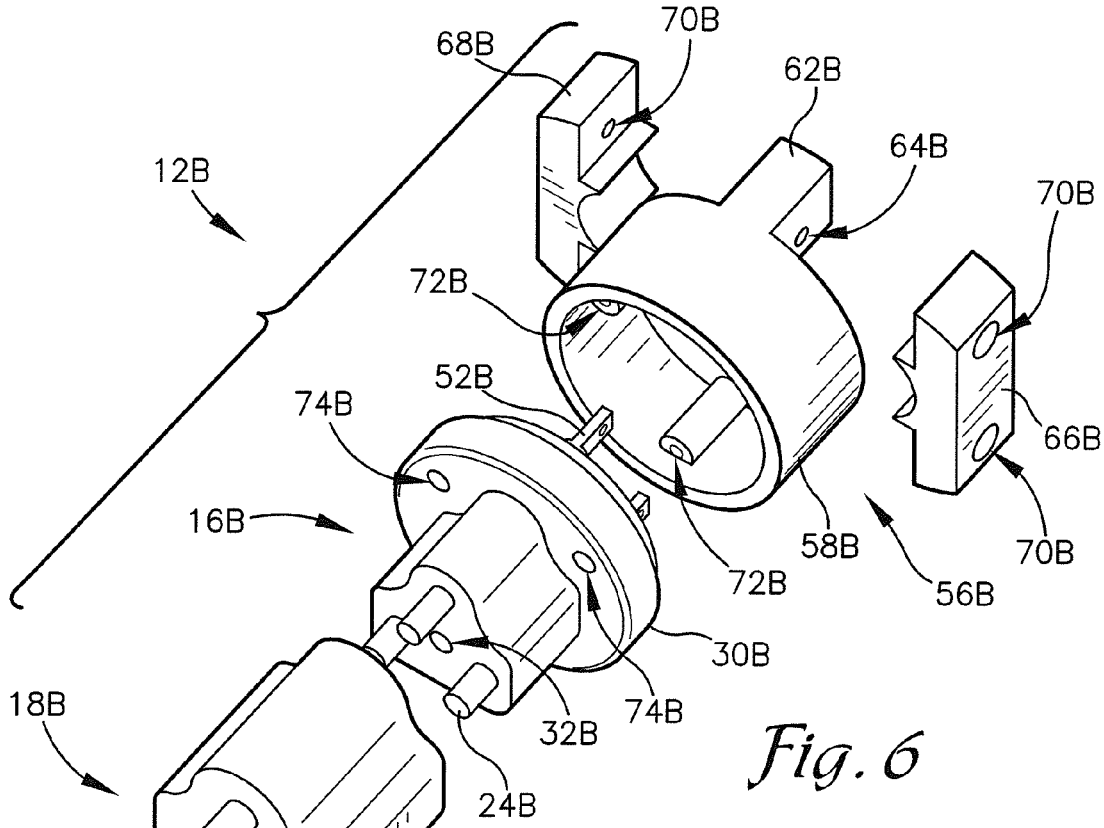
Figure 7:
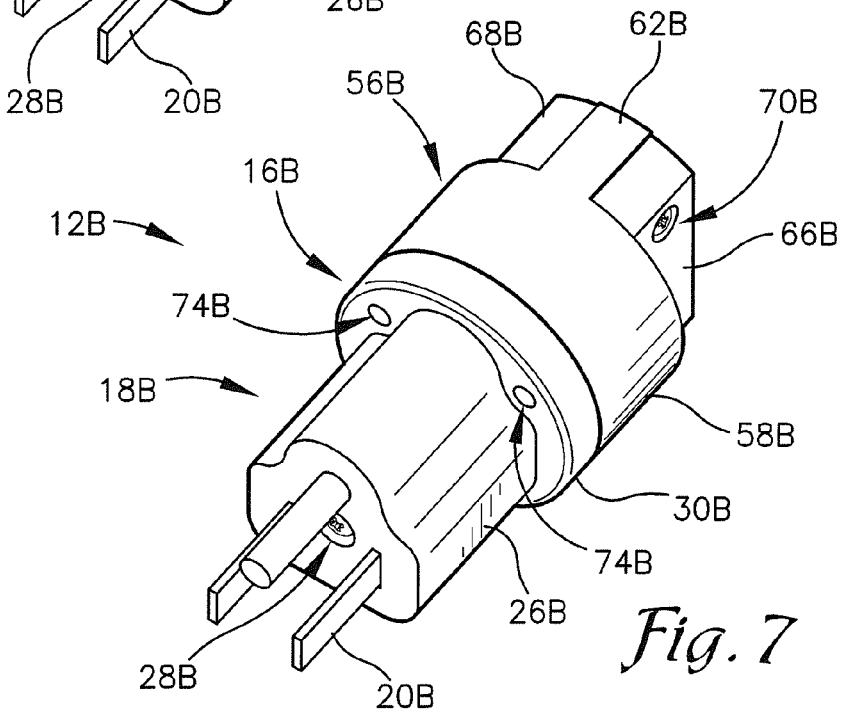
Figure 8:
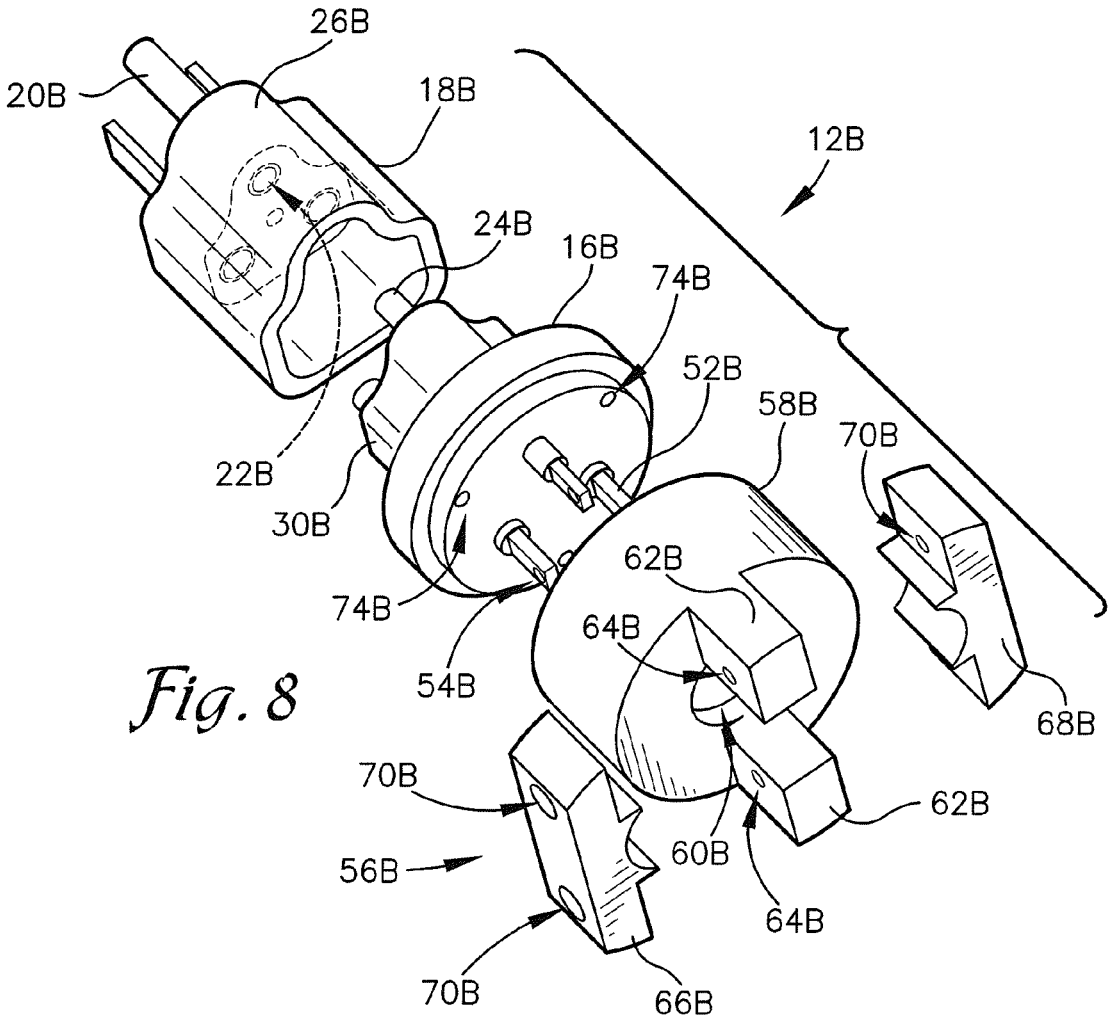
Figure 9:
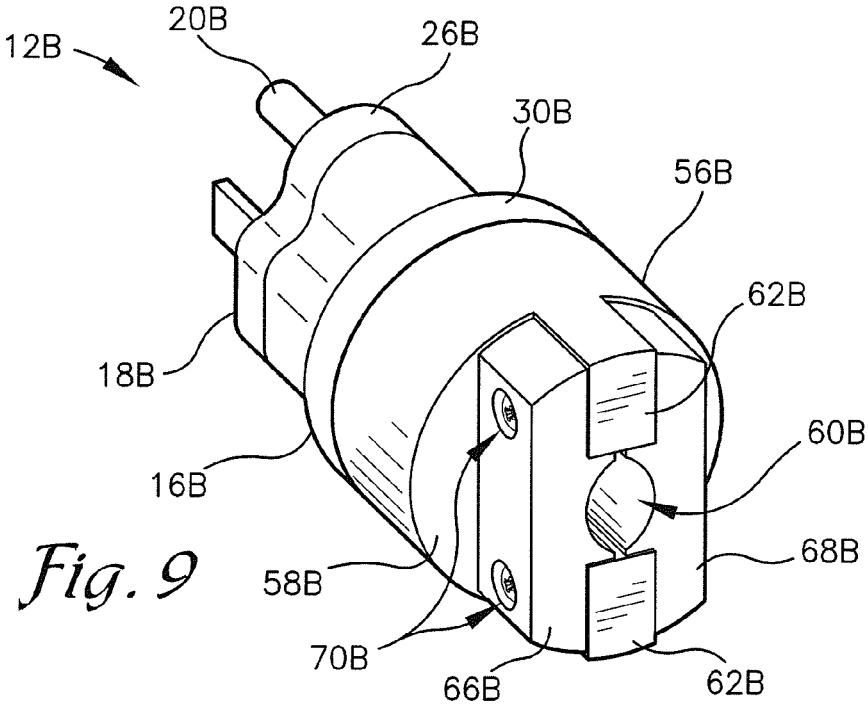
Figure 10:
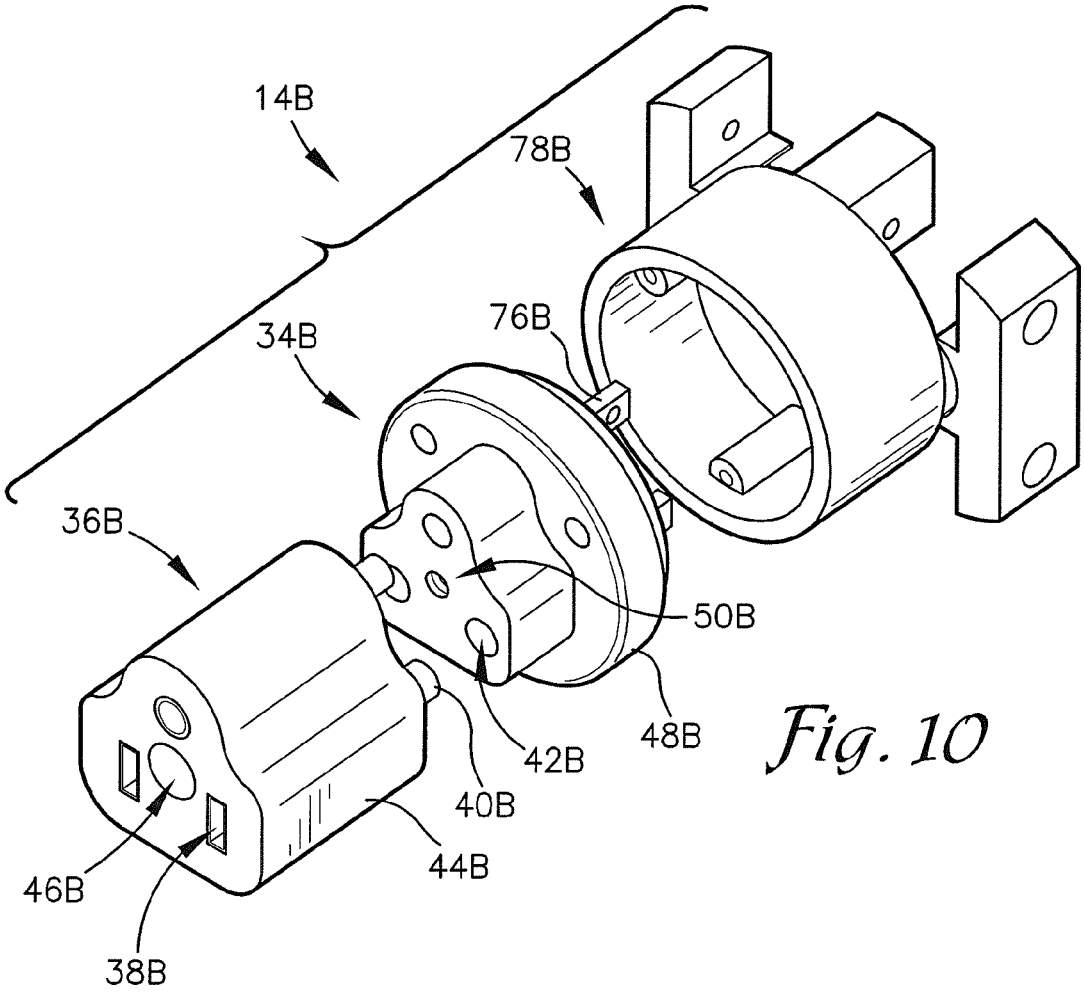
Figure 11:
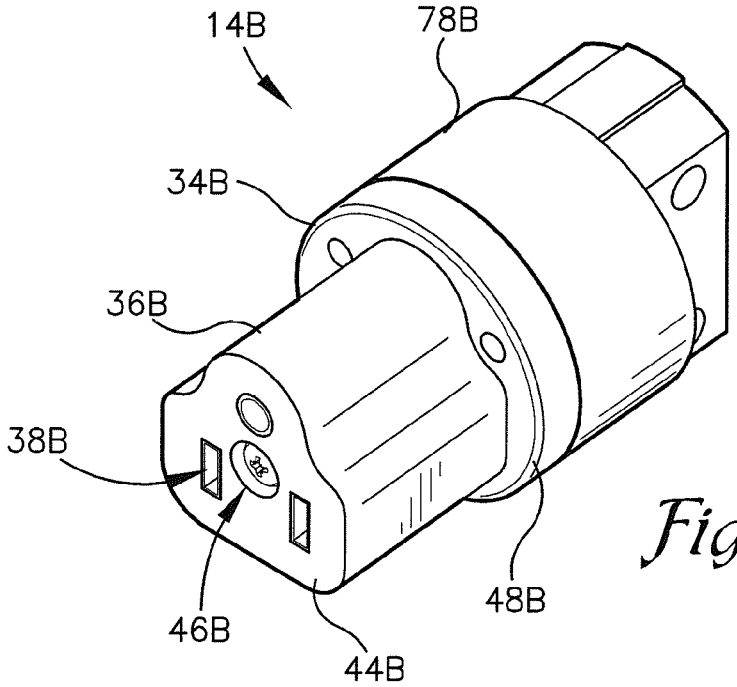

FIG. 5. is an exploded perspective view of the female replacement plug of FIG. 4;

FIG. 6 is a front exploded perspective view of a male replacement plug constructed in accordance with a second embodiment of the present invention;

FIG. 7 is a front perspective view of the male replacement plug of FIG. 6;

FIG. 8 is an exploded rear perspective view of the male replacement plug of FIG. 6;

FIG. 9 is a rear perspective view of the male replacement plug of FIG. 6;

FIG. 10 is an exploded front perspective view of a female replacement plug constructed in accordance with the second embodiment of the invention; and FIG. 11 is a front perspective view of the female replacement plug of FIG. 10.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Various embodiments of the present invention are illustrated in FIGS. 1-11 with the same or similar components in each embodiment identified by the same reference numeral followed by a different letter.

EMBODIMENT 1

Hardwired Plugs

Figure 1:
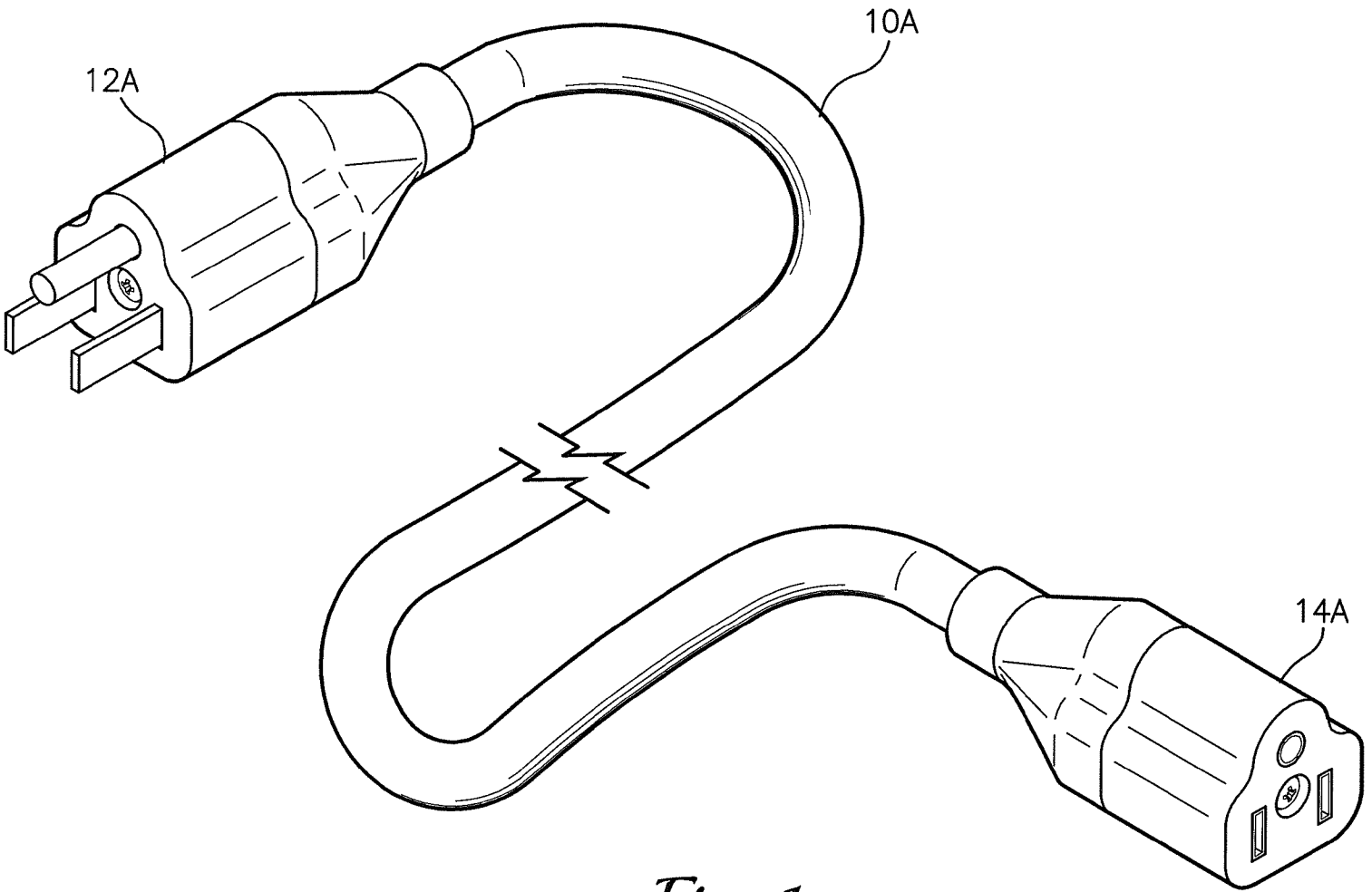
FIG. 1 is a fragmentary perspective view of an electrical cord having electrical cord plugs constructed in accordance with a first embodiment of the present invention.

In a first embodiment of the invention illustrated in FIG. 1, an electrical cord 10A is physically and electrically connected to a male replaceable plug 12A at a first end of the electrical cord 10A and/or a female replaceable plug 14A at a second end of the electrical cord 10A. Specifically, conductive wires in the electrical cord 10A may be electrically isolated from each other by non-conductive material and may be physically and electrically connected to conductive elements of the male and/or female replaceable plugs 12A,14A, as later described herein. The male replaceable plug 12A may be configured to detachably and electrically couple with an electrical outlet, a female electrical plug, or various other power sources or receptacles. The female electrical cord plug 14A may be configured to detachably and electrically couple with a male electrical plug, such as those found on extension cords or various electrically-powered device. Note that, although FIG. 1 illustrates both the male and female replaceable plugs 12A,14A attached to the single electrical cord 10A, various electrical cords may be hardwired at one end to an electrical device or an electricity source with only one end of the electrical cord having either the male or female replaceable plug attached thereto.

Figure 2:
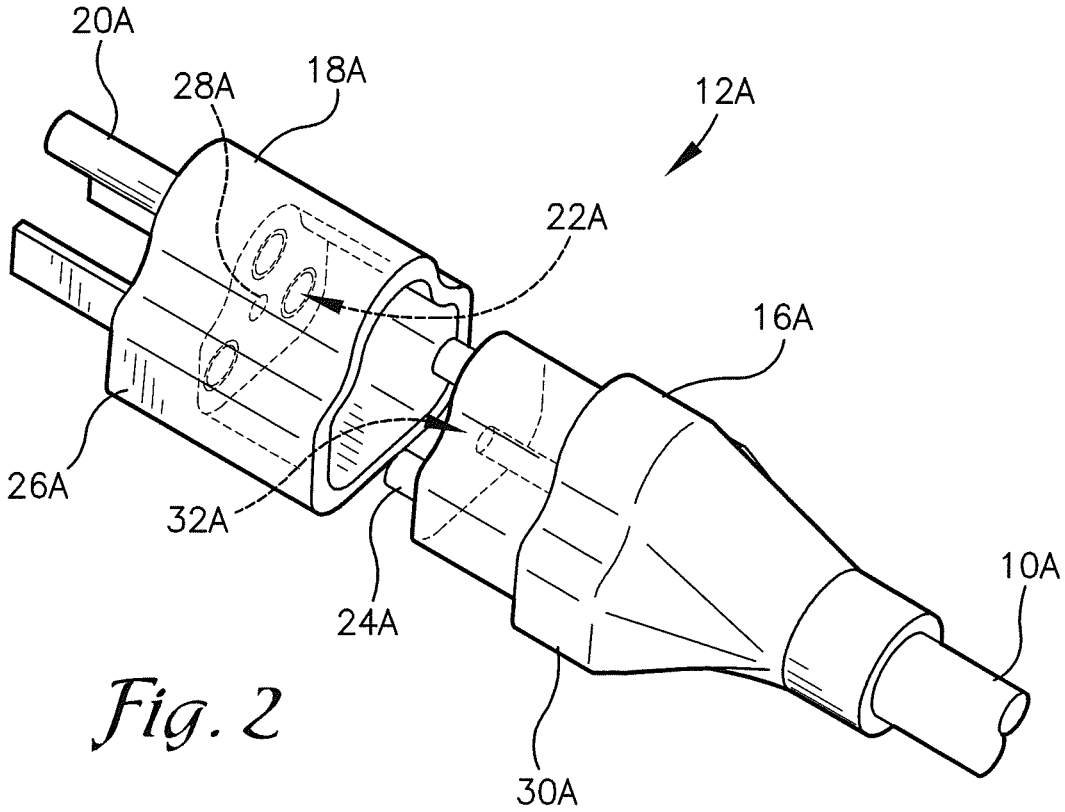
FIG. 2 is an exploded perspective view of a male replacement plug of the electrical cord of FIG. 1.
Figure 3:
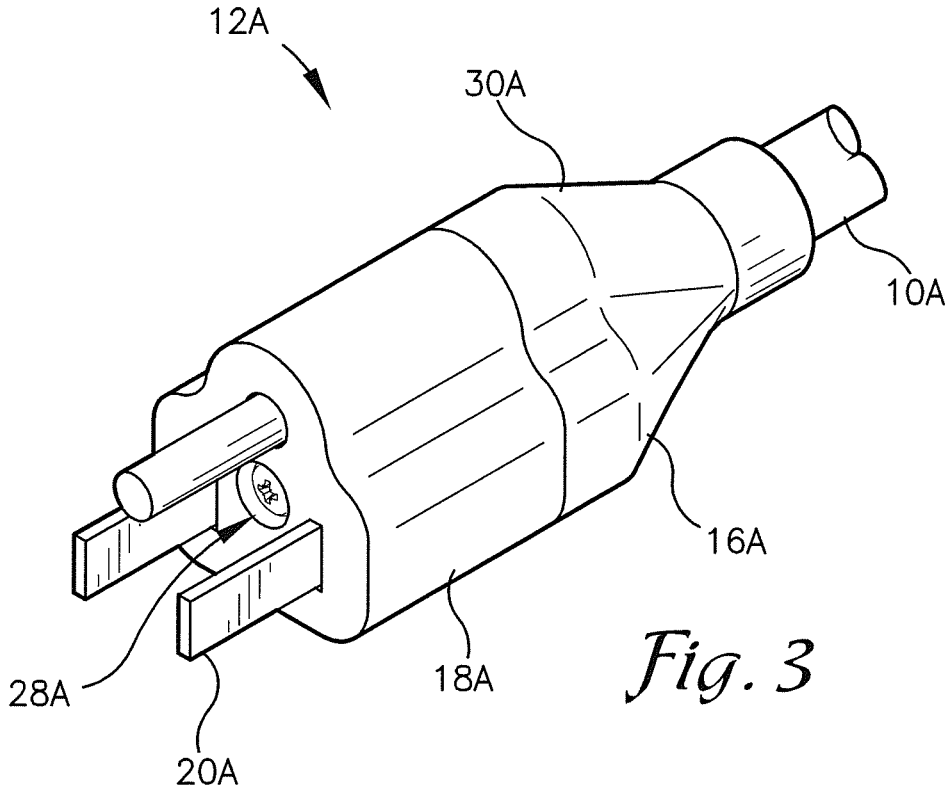
FIG. 3 is a perspective view of the male replacement plug of FIG. 2.

As illustrated in FIGS. 2 and 3, the male replaceable plug 12A may have a male receiving plug 16A and a male detachable plug 18A configured to detachable attach to the male receiving plug 16A. The male receiving plug 16A may be physically and electrically coupled to the electrical cord 10A and the male detachable plug 18A may be physically and electrically coupled to the male receiving plug 16A. The male detachable plug 18A may comprise a plurality of conductive prongs 20A, such as three standard electrical plug prongs configured to fit into a standard home or office electrical socket. The male detachable plug 18A may also comprise a plurality of conductive ports 22A each conductively or electrically coupled with one of the conductive prongs 20A. The phrase "conductive prongs" as used herein may refer to protrusions, flanges, rods, rigid strips of material, or the like made of any electrically-conductive material of any size or shape required for a given application. The phrase "conductive ports" as used herein may refer to any indentions, sockets, receptacles, or the like made of or lined with or made of any electrically-conductive material of any size or shape as required for a given application.

In this first embodiment of the invention, the electrical cord 10A may be hardwired to a conductive material within the male receiving plug 16A. Specifically, the male receiving plug 16A may comprise a plurality of conductive prongs 24A, such as three prongs, conductively coupled with the wires of the electrical cord 10A. The conductive prongs 24A of the male receiving plug 16A may be sized and shaped to mate with the conductive ports 22A of the male detachable plug 18A, thereby electrically coupling the male detachable plug 18A and the male receiving plug 16A. Note that at least one of the conductive prongs 24A of the male receiving plug 16A may have a different cross-sectional shape and/or size than a corresponding one of the conductive prongs 20A of the male detachable plug 18A. Specifically, the shape and/or size of the conductive prongs 24A of the male receiving plug 16A may be configured to prevent their insertion into an electrical outlet without attachment of the male detachable plug 18A. For example, the conductive prongs 20A of the male detachable plug 18A may comprise two substantially flattened prongs having rectangular cross sections and one rod-like prong having a circular cross section, while the conductive prongs 24A of the male receiving plug 16A may all three be rod-like with a circular cross section.

The male detachable plug 18A may have a non-conductive housing 26A in which its conductive ports 22A are held and from which its conductive prongs 20A extend. The non-conductive housing 26A of the male detachable plug 18A may be configured to slide over or otherwise interface with at least a portion of the male receiving plug 16A. Furthermore, the non-conductive housing 26A of the male detachable plug 18A may have at least one attachment hole 28A formed therethrough and configured for receiving a screw or some other fastener to mechanically attach the male detachable plug 18A with the male receiving plug 16A.

The male receiving plug 16A may also have a non-conductive housing 30A configured for attaching to and retaining an end portion of the electrical cord 10A and fixing the conductive prongs 24A of the male receiving plug 16A in proper orientation to mate with the conductive ports 22A of the male detachable plug 18A. As illustrated in FIG. 2, at least a portion of the non-conductive housing 30A of the male receiving plug 16A may have a cross-sectional shape sized and configured to slide into and mate with a portion of the non-conductive housing 26A of the male detachable plug 18A. Furthermore, the non-conductive housing 30A of the male receiving plug 16A may have an attachment port 32A, opening, or threaded tube configured for mating with an end of the screw or another attachment device configured for extending through the attachment hole 28A of the male detachable plug 18A for attaching the male detachable plug 18A with the male receiving plug 16A.

In use, if one of the conductive prongs 20A or the non-conductive housing 26A of the male detachable plug 18A is damaged, the screw or attachment device may be removed and the male detachable plug 18A may be removed from the male receiving plug 16A. Then a substantially identical male detachable plug may be slid onto or otherwise joined with the male receiving plug 16A and attached thereto with the screw or attachment device. This provides quick and easy replacement of damaged electrical cord ends without the need for cutting the electrical wire and splicing the electrical wire with a new male electrical plug.

As illustrated in FIGS. 4 and 5, the female replaceable plug 14A may be constructed similar to the male replaceable plug 12A, but may be configured for receiving male electrical plugs as opposed to being inserted into a conventional electrical outlet. The female replaceable plug 14A may comprise a female receiving plug 34A and a female detachable plug 36A configured to detachably attach to the female receiving plug 32A. The female receiving plug 34A may be physically and electrically coupled to the electrical cord 10A and the female detachable plug 36A may be physically and electrically coupled to the female receiving plug 34A. The female detachable plug 36A may comprise a plurality of conductive ports 38A, such as three conductive ports configured for mating with prongs of a male electrical plug. For example, the conductive ports 38A of the female detachable plug 36A may receive conductive prongs of a male electrical plug of an extension cord or any other electrical cord. The female detachable plug 36A may also comprise a plurality of conductive prongs 40A conductively or electrically coupled with the conductive ports 38A of the female detachable plug 36A.

As with the male replaceable plug 12A, the electrical cord 10A may be hardwired to a conductive material within the female receiving plug 34A of the female replaceable plug 14A. Specifically, the female receiving plug 34A may comprise a plurality of conductive ports 42A, such as three ports, conductively coupled with wires of the electrical cord 10A. The conductive ports 42A of the female receiving plug 34A may be sized and shaped to mate with the conductive prongs 40A extending from the female detachable plug 36A, thereby electrically coupling the female detachable plug 36A and the female receiving plug 34A. Note that at least one of the conductive ports 42A of the female receiving plug 34A may have a different cross-sectional shape and/or size than a corresponding one of the conductive ports 38A of the female detachable plug 36A. Specifically, the shape and/or size of the conductive ports 42A of the female receiving plug 34A may be configured to prevent insertion of prongs of a male electrical plug therein without attachment of the female detachable plug 36A. For example, two of the conductive ports 38A of the female detachable plug 36A may have substantially rectangular cross sections and one of the conductive ports 38A of the female detachable plug 36A may have a circular cross section, while all of the conductive ports 42A of the female receiving plug 34A may have a circular cross section.

The female detachable plug 36A may have a non-conductive housing 44A in which its conductive ports 38A are held and from which its conductive prongs 40A extend. The non-conductive housing 44A of the female detachable plug 36A may be configured to contact or otherwise interface with at least a portion of the female receiving plug 34A. Furthermore, the non-conductive housing 44A of the female detachable plug 36A may have at least one attachment hole 46A formed therethrough and configured for receiving a screw or some other fastener to mechanically attach the female detachable plug 36A with the female receiving plug 34A.

The female receiving plug 34A may also have a non-conductive housing 48A configured for attaching to and retaining an end portion of the electrical cord 10A and fixing the conductive ports 42A of the female receiving plug 34A therein in proper orientation to mate with the conductive prongs 40A of the female detachable plug 36A. The non-conductive housing 48A of the female receiving plug 34A may have an attachment port 50A, opening, or threaded tube configured for mating with an end of the screw or another attachment device configured for extending through the attachment hole 46A of the female detachable plug 36A for attaching the female detachable plug 36A with the female receiving plug 34A.

In use, if one of the conductive ports 38A or the non-conductive housing 44A of the female detachable plug 36A is damaged, the screw or attachment device may be removed and the female detachable plug 36A may be removed from the female receiving plug 34A. Then a substantially identical female detachable plug may mate with the female receiving plug 34A, such that the conductive prongs 40A of the female detachable plug 36A slide into the conductive ports 42A of the female receiving plug 34A. The female detachable plug 36A may then be attached to the female receiving plug 34A with the screw or attachment device. This provides quick and easy replacement of damaged electrical cord ends without the need for cutting the electrical wire and splicing the electrical wire with a new female electrical plug. Note that the female detachable plug 36A is designed such that it cannot physically and electrically connect with the male receiving plug 16A and the male detachable plug 18A is designed such that it cannot physically and electrically connect with the female receiving plug 34A.

EMBODIMENT 2

Replacement Plugs

A second embodiment of the invention includes male and/or female replacement plugs 12B,14B similar to the male and female replaceable plugs 12A,14A described above. However, unlike the male and female replaceable plugs 12A,14A hardwired or preassembled with the electrical cord 10A, the male and/or female replacement plugs 12B,14B may be sold or provided separately from an electrical cord and physically and electrically coupled with the electrical cord during aftermarket repair thereof.

As illustrated in FIGS. 6-9, the male replacement plug 12B may comprise a male detachable plug 18B and a male receiving plug 16B having an identical or similar configuration as the male detachable plug 18A and the male receiving plug 16A described above. Specifically, the male detachable plug 18B may comprise identical components to that of the male detachable plug 18A described above, including conductive prongs 20B, conductive ports 22B, and a non-conductive housing 26B. Likewise, the male receiving plug 16B may comprise identical components to that of the male receiving plug 16A described above, including the conductive prongs 24B and the non-conductive housing 30B.

However, in the second embodiment of the invention the male receiving plug 16B is not pre-hardwired to an electrical cord. Rather, the male receiving plug 16B may further comprise wire termination prongs 52B extending therefrom, such as three wire termination prongs conductively or electrically coupled with the conductive prongs 24B of the male receiving plug 16B. The wire termination prongs 52B may be configured for conductively or electrically coupling to wires of any electrical cord during repair thereof. For example, the wire termination prongs 52B may each have at least one hole 54B formed therethrough such that a corresponding wire of an electrical cord can be threaded therethrough and mechanically fixed or soldered to the wire termination prong 52B.

Furthermore, the male replacement plug 12B may also comprise a cord clamp 56B configured for fixing an end of an electrical cord relative to the male receiving plug 16B and shielding the wire termination prongs 52B and exposed wires of the electrical cord from outside elements. Specifically, the cord clamp 56B of the male replacement plug 12B may comprise a hollow housing portion 58B configured to mate with the non-conductive housing 30B of the male receiving plug 16B. The hollow housing portion 58B may have a hole 60B formed therethrough through which an electrical cord may extend to attach to the male receiving plug 16B. The cord clamp 56B may also have at least one flange 62B extending therefrom with at least one hole 64B formed therethrough, and two retaining pieces 66B,68B with holes 70B formed therethough. When an electrical cord is threaded through the hole 60B of the hollow housing portion 58B, the two retaining pieces 66B,68B may attach to opposing sides of the flange 62B via a mechanical fastener threaded through the holes 70B of the retaining pieces 66B,68B and the hole 64B of the flange 62B. In this configuration, the two retaining pieces 66B,68B cooperatively clamp the electrical cord to the cord clamp 56B. In some embodiments of the invention, two flanges extending from opposing sides of the hole 60B may each be mechanically attached to the retaining pieces 66B,68B.

As in the first embodiment of the invention, the non-conductive housings 26B,30B of the male detachable plug 18B and the male receiving plug 16B may each have a hole 28B, port 32B, or threaded socket formed therethrough and configured to be aligned to mechanically attach the non-conductive housings 26B,30B with each other using a mechanical fastener such as a screw. Likewise, the cord clamp 56B may comprise holes, ports 72B, or threaded sockets configured to align with other holes 74B formed through the non-conductive housing 30B of the male receiving plug 16B to mechanically attach the male receiving plug 16B with the cord clamp 56B.

In use, if a typical male electrical plug hardwired to an electrical cord is damaged, the electrical cord may be cut to remove the original male electrical plug. Then the cord clamp 56B may be slid over the electrical cord and wires of the electrical cord may be physically and electrically connected to the wire termination prongs 52B of the male receiving plug 16B. The male receiving plug 16B may then be fixed to the cord clamp 56B, mechanically or otherwise, such that the wire termination prongs 52B are housed within the hollow housing portion 58B of the cord clamp 56B. Then retaining pieces 66B,68B of the cord clamp 56B may be mated with the flange 62B of the cord clamp 56B on opposing sides of the flange 62B and fixed to the flange 62B (or flanges). For example, the holes 70B of the retaining pieces 66B,68B may be aligned with a hole 64B or holes formed through the flange 62B and a mechanical fastener, such as a screw, may be threaded therethrough and fixed and tightened with a bolt. In this configuration, the retaining pieces 66B,68B and the flange 62B may cooperatively surround a portion of the electrical cord and clamp the electrical cord to the cord clamp 56B. Then the male detachable plug 18B may be mechanically attached to the male receiving plug 16B via a screw or other attachment device such that the conductive prongs 24B of the male receiving plug 16B physically and electrically engage with the conductive ports 22B of the male detachable plug 18B.

If one of the conductive prongs 20B or the non-conductive housing 26B of the male detachable plug 18B is damaged, the screw or attachment device may be removed from the male detachable plug 18B and then the male detachable plug 18B may be removed from the male receiving plug 16B. A substantially identical male detachable plug may be slid onto or otherwise joined with the male receiving plug 16B and attached thereto with the screw or attachment device. During this replacement, the cord clamp 56B and the male receiving plug 16B remain secured to the electrical cord. This provides quick and easy replacement of damaged electrical cord ends without the need for subsequent cutting of the electrical wire and splicing the electrical wire with a new male electrical plug.

As illustrated in FIGS. 10 and 11, the female replacement plug 14B may comprise a female detachable plug 36B and a female receiving plug 34B having an identical or similar configuration as the female detachable plug 36A and the female receiving plug 36A described above. Specifically, the female detachable plug 36B may comprise components identical to that of the female detachable plug 36A described above, including conductive ports 38B, conductive prongs 40B, and a non-conductive housing 44B. Likewise, the female receiving plug 34B may comprise the components of the female receiving plug 34A described above, including conductive ports 42B and the non-conductive housing 48B.

However, the female receiving plug 34B is not pre-hardwired to an electrical cord. Rather, the female receiving plug 34B may further comprise wire termination prongs 76B extending therefrom, such as three wire termination prongs conductively or electrically coupled with the conductive ports of the female receiving plug 34B. The wire termination prongs 76B may be substantially identical to the wire termination prongs 52B described above for the male receiving plug 16B.

Furthermore, the female replacement plug 14B may also comprise a cord clamp 78B configured for fixing an end of an electrical cord relative to the female receiving plug 34B and shielding the wire termination prongs 76B and exposed wires of the electrical cord from outside elements. The cord clamp 78B may be substantially identical to the cord clamp 56B described above and may interface with the female receiving plug 34B in substantially the same manner as the cord clamp 56B interfaces with the male receiving plug 16B.

As in the first embodiment of the invention, the non-conductive housings 44B,48B of the female detachable plug 36B and the female receiving plug 34B may each have a hole 46B, port 50B, or threaded socket formed therethrough and configured to be aligned to mechanically attach the non-conductive housings 44B,48B with each other using a mechanical fastener such as a screw. Likewise, the cord clamp 78B may comprise holes or threaded sockets configured to align with other holes formed through the female receiving plug's non-conductive housing 48B to mechanically attach the female receiving plug 34B with the cord clamp 78B.

In use, if a typical female electrical plug hardwired to an electrical cord is damaged, the electrical cord may be cut to remove the original female electrical plug. Then the cord clamp 78B may be slid over the electrical cord and wires of the electrical cord may be physically and electrically connected to the wire termination prongs 76B of the female receiving plug 34B. The female receiving plug 34B may then be fixed to the cord clamp 78B, mechanically or otherwise, such that the wire termination prongs 76B are housed within the cord clamp 78B. Then the cord clamp 78B may be clamped to the electrical cord as described above. The female detachable plug 36B may be mechanically attached to the female receiving plug 34B via a screw or other attachment device such that the conductive ports 42B of the female receiving plug 34B are physically and electrically engaged with the conductive prongs 40B of the female detachable plug 36B.

If one of the conductive ports 38B or the non-conductive housing 44B of the female detachable plug 36B is damaged, the screw or attachment device may be removed from the female detachable plug 36B and then the female detachable plug 36B may be removed from the female receiving plug 34B. A substantially identical female detachable plug may be slid into or otherwise joined with the female receiving plug 34B and attached thereto with the screw or attachment device. During this replacement, the cord clamp 78B and the female receiving plug 34B remain secured to the electrical cord. This provides quick and easy replacement of damaged electrical cord ends without the need for subsequent cutting of the electrical wire and splicing the electrical wire with a new female electrical plug.

Although the invention has been described with reference to the preferred embodiment illustrated in the attached drawing figures, it is noted that equivalents may be employed and substitutions made herein without departing from the scope of the invention as recited in the claims. For example, the various holes and attachment ports shown in the drawing figures for insertion of screws and the like are merely exemplary attachment provisions. Any method of detachably, mechanically joining the various components of the male and female replaceable plugs 12A,14A or the male and female replacement plugs 12B,14B may be used without departing from the scope of the invention.

Having thus described various embodiments of the invention, what is claimed as new and desired to be protected by Letters Patent includes the following:

1. An electrical cord plug comprising:

a detachable plug comprising a plurality of conductive ports, a plurality of conductive prongs electrically connected with the conductive ports, and a non-conductive housing configured for housing the conductive prongs and the conductive ports of the detachable plug; and a receiving plug configured to be physically and electrically coupled with wires of an electrical cord and physically and electrically coupled with the detachable plug, the receiving plug either comprising a plurality of conductive ports configured to physically and electrically connect with the conductive prongs of the detachable plug or comprising a plurality of conductive prongs configured to physically and electrically connect with the conductive ports of the detachable plug, wherein the receiving plug further comprises a non-conductive housing configured for housing the conductive prongs or the conductive ports of the receiving plug and configured to interface with and detachably attach to the non-conductive housing of the detachable plug, wherein the detachable plug is physically independent of any electrical cord except when physically and electrically coupled with the receiving plug, wherein the conductive ports of the detachable plug are each hollow inlets formed into the non-conductive housing of the detachable plug and each comprise conductive material, wherein the conductive ports of the receiving plug are each hollow inlets formed into the non-conductive housing of the receiving plug and each comprise conductive material.

2. The electrical cord of claim 1, wherein at least one of the conductive prongs of the receiving plug has a different size or shape than a corresponding one of the conductive prongs of the detachable plug or wherein at least one of the conductive ports of the receiving plug has a different size or shape than a corresponding one of the conductive ports of the detachable plug.

3. The electrical cord plug of claim 1, wherein the detachable plug is a male detachable plug, the conductive prongs of the detachable plug are sized and shaped to plug into an electrical outlet, and the conductive ports of the detachable plug are configured to physically and electrically connect with the conductive prongs of the receiving plug.

4. The electrical cord plug of claim 1, wherein the detachable plug is a female detachable plug, the conductive ports of the detachable plug are sized and shaped to receive prongs of a male electrical plug, and the conductive prongs of the detachable plug are configured to physically and electrically connect with the conductive ports of the receiving plug.

5. The electrical cord plug of claim 1, wherein the receiving plug further comprises wire termination prongs configured for physically and electrically coupling with the wires of the electrical cord.

6. The electrical cord of claim 5, further comprising a cord clamp configured for physically attaching to the receiving plug and clamping the electrical cord, the cord clamp comprising:

a hollow housing portion configured to mate with the receiving plug and house the wire termination prongs, the hollow housing portion having a hole formed therethrough sized and shaped for the electrical cord to extend therethrough such that wires of the electrical cord can be physically and electrically coupled with the wire termination prongs of the receiving plug;

at least one flange extending from the hollow housing portion; and two retaining pieces configured to mechanically attach to opposing sides of the flange and cooperatively clamp the electrical cord between the two retaining pieces and the flange.

* * * * *